United States Patent [19]

Ishiguro et al.

[11] Patent Number: 4,738,918

[45] Date of Patent: Apr. 19, 1988

[54] PROCESS FOR PROCESSING SILVER HALIDE PHOTOGRAPHIC MATERIAL

[75] Inventors: Shoji Ishiguro; Hiroyuki Mifune; Shigeo Hirano; Nobuyuki Iwasaki, all of Kanagawa, Japan

[73] Assignee: Fuji Photo Film Co., Ltd., Kanagawa, Japan

[21] Appl. No.: 907,335

[22] Filed: Sep. 15, 1986

[30] Foreign Application Priority Data

Sep. 13, 1985 [JP] Japan ..... 60-202795

[51] Int. Cl.[4] ..... G03C 5/24

[52] U.S. Cl. ..... 430/445; 430/446; 430/489; 430/487; 430/610; 430/611

[58] Field of Search ..... 430/440, 445, 446, 489, 430/487, 600, 611

[56] References Cited

FOREIGN PATENT DOCUMENTS 3308203 9/1983 Fed. Rep. of Germany ..... 430/600

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A process for processing silver halide photographic material is disclosed, which comprises development-processing a silver halide photographic material in the presence of a compound represented by formula (I) or a salt thereof with an inorganic or organic acid:

(I)

wherein

Z represents an atomic group of carbon atoms, nitrogen atoms, or a combination thereof forming a 5-, 6-, or 7-membered unsaturated heterocyclic ring, said unsaturated heterocyclic ring being optionally fused with a monocyclic or bicyclic aryl group;

$R^0$ represents $-SR^1$, $-SO-R^2$, $-SO_2-R^3$ or $-N\begin{matrix}R^4\\R^5\end{matrix}$;

$R^1$ represents an alkyl group, a substituted alkyl group, an aryl group, or a substituted aryl group;

$R^2$ and $R^3$ each represents a hydrogen atom, an alkyl group, a substituted alkyl group, an aryl group, a substituted aryl group, an alkoxy group, a substituted alkoxy group, an amino group, or a substituted amino group;

$R^4$ represents a hydrogen atom, an alkyl group, a substituted alkyl group, an aryl group or a substituted aryl group; and $R^5$ represents an acyl group, a sulfinyl group, a sulfonyl group, or a carbamoyl group, or represents a group selected from the groups represented by $R^1$, $R^2$, $R^3$ and $R^4$.

11 Claims, No Drawings

PROCESS FOR PROCESSING SILVER HALIDE PHOTOGRAPHIC MATERIAL

FIELD OF THE INVENTION

This invention relates to a process for forming images in silver halide photographic materials. More particularly, it relates to a process for developing a silver halide photographic material in the presence of a particular amino compound to form image with high sensitivity without serious fogging.

BACKGROUND OF THE INVENTION

Various compounds have been studied to use for enhancing sensitivity of silver halide photographic materials. It is well known to add amino compounds such as alkylamines, ammonia, hydroxylamines, pyridines, ethylenediamines, imidazoles, etc., to silver halide light-sensitive materials or to developers to accelerate development and obtain high sensitivity. This technique is described in detail, e.g., in *Research Disclosure,* RD No. 17643 (December 1978), *The Theory of the Photographic Process,* p. 424 (edited by T. H. James and published by MacMillan Co.), etc.

However, such amino compounds have the defect that, although they accelerate development to some extent to enhance sensitivity, there results considerably increased fog together with an increase in sensitivity when they are added to a silver halide emulsion or to a developer.

SUMMARY OF THE INVENTION

Therefore, one object of the present invention is to provide a process for processing a silver halide material to form image with high sensitivity without serious increase of fog.

This and other objects of the present invention will become more apparent from the following description thereof.

The above-described and other objects of the present invention are attained by development-processing silver halide photographic materials in the presence of (for example, by adding to a silver halide photographic material and/or to a developer or a pre-bath thereof) a compound represented by formula (I) or a salt thereof with an organic or inorganic acid:

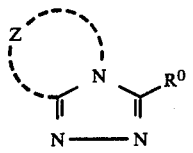

(I)

wherein:

Z represents carbon atoms, nitrogen atoms, or a combination thereof forming a 5-, 6-, or 7-membered unsaturated heterocyclic ring (including an unsaturated heterocyclic ring fused with a monocyclic or bicyclic aryl group);

$R^0$ represents $$-SR^1,\ -SO-R^2,\ -SO_2-R^3 \text{ or } -N\begin{matrix}R^4\\R^5\end{matrix};$$

$R^1$ represents an alkyl group, a substituted alkyl group, an aryl group, or a substituted aryl group;

$R^2$ and $R^3$ each represents a hydrogen atom, an alkyl group, a substituted alkyl group, an aryl group, a substituted aryl group, an alkoxy group, a substituted alkoxy group, an amino group, or a substituted amino group;

$R^4$ represents a hydrogen atom, an alkyl group, a substituted alkyl group, an aryl group or a substituted aryl group; and $R^5$ represents an acyl group, a sulfinyl group, a sulfonyl group or a carbamoyl group, or represents a group selected from the groups represented by $R^1$, $R^2$, $R^3$ and $R^4$.

DETAILED DESCRIPTION OF THE INVENTION

Describing the invention in more detail, examples of the unsaturated heterocyclic ring represented by

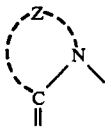

include pyrrole, pyrazole, imidazole, triazole, tetrazole, pyridine, pyridazine, pyrimidine, pyrazine, triazine, azepine, diazepine, and hydrogenated derivatives thereof. Examples of the aryl group fused to these unsaturated heterocyclic include benzene and naphthalene.

These unsaturated heterocyclic rings and the aryl groups fused thereto may further be substituted by one or more suitable substituents. Examples of suitable substituents include an alkyl group (containing preferably from 1 to 20 carbon atoms; e.g., a methyl group, an ethyl group, a secoctyl group, etc.), an aryl group (containing preferably from 6 to 20 carbon atoms; e.g., a phenyl group, a naphthyl group, etc.), an alkoxy group (containing preferably from 1 to 20 carbon atoms; e.g., a methoxy group, a hexadecyl group, etc.), an aryloxy group (containing preferably from 6 to 20 carbon atoms; e.g., a phenoxy group, a naphthyloxy group, etc.), an alkylthio group (containing preferably from 1 to 20 carbon atoms; e.g., a methylthio group, a dodecylthio group, etc.), an arylthio group (containing preferably from 6 to 20 carbon atoms; e.g., a phenylthio group, etc.), a halogen atom (e.g., a fluorine atom, a chlorine atom, a bromine atom, an iodine atom, etc.), an acylamino group (containing preferably from 1 to 20 carbon atoms; e.g., an acetamido group, a benzamido group, etc.), a sulfonamido group (containing preferably from 1 to 20 carbon atoms; e.g., a methanesulfonamido group, a benzenesulfonamido group, etc.), an ureido group (containing preferably from 1 to 20 carbon atoms; e.g., a methylureido group, a hexylureido group, a phenylureido group, etc.), a cyano group, a carboxyl group, a carbamoyl group (containing preferably from 1 to 20 carbon atoms; e.g., a carbamoyl group, an N-methylcarbamoyl group, an N-phenylcarbamoyl group, etc.), a sulfamoyl group (containing preferably from 1 to 20 carbon atoms; e.g., a sulfamoyl group, an N-methylsulfamoyl group, an N-phenylsulfamoyl group, etc.), an acyloxy group (containing preferably from 1 to 20 carbon atoms; e.g., an acetoxy group, a benzoxy group, etc.), an alkoxycarbonyl group (containing preferably from 2 to 20 carbon atoms; e.g., a methoxycarbonyl group, a dodecyloxycarbonyl group, etc.), an aryloxycarbonyl group (containing preferably from 7 to 20 carbon atoms; e.g., a phenoxycarbonyl group, etc.), an acyl group (containing preferably from 1 to 20 carbon atoms; e.g., a formyl group, an acetyl group, a benzoyl group, etc.), an amino group (containing preferably up to 20 carbon atoms, more preferably from 2 to 12 carbon atoms; e.g., an amino group, an N-methylamino group, an N,N-dimethylamino group, an N-propylamino group, an N-phenylamino group, etc.), an imino group (containing preferably up to 20 carbon atoms; e.g., an imino group, an N-methylimino group, an N-phenylimino group, etc.), a nitroso group, an alkenyl group (containing preferably from 2 to 20 carbon atoms; e.g., an allyl group, etc.), an alkynyl group (containing preferably from 2 to 20 carbon atoms; e.g., a propargyl group, etc.), a sulfonyl group (containing preferably 1 to 20 carbon atoms; e.g., a methanesulfonyl group, a benzenesulfonyl group, etc.), a hydroxy group, etc.

These substituents may further be substituted by the above-described substituents.

The unsaturated heterocyclic ring represented by

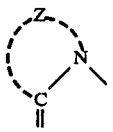

are preferably 6-membered rings, more preferably those derived from a pyridine ring or a pyridazine ring. The most preferable are those wherein a benzene ring is fused to the pyridine or pyridazine zing.

Examples of $R^0$ include

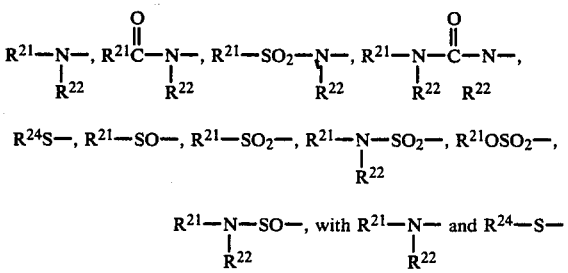

being preferable.

$R^{21}$, $R^{22}$, and $R^{23}$ may be the same or different, and each represents a hydrogen atom, an aliphatic group or an aromatic group, and $R^{24}$ represents an aliphatic or aromatic group.

Examples of the aliphatic group represented by $R^{21}$, $R^{22}$, $R^{23}$, and $R^{24}$ include a straight or branched alkyl group, an alkenyl group, an alkynyl group or a cycloalkyl group. Examples of the alkyl group include those which contain from 1 to 18 carbon atoms, preferably from 1 to 6 carbon atoms, such as a methyl group, an ethyl group, a propyl group, a butyl group, a dodecyl group, an isopropyl group, a t-butyl group, a 2-ethylhexyl group, etc. Examples of the alkenyl group include those which contain from 2 to 20 carbon atoms, such as an ally group and a 2-butenyl group. Examples of the alkynyl group include those which contain from 2 to 20 carbon atoms, such as a propargyl group and a 2-butynyl group. Examples of the cycloalkyl group include those which contain from 3 to 12 carbon atoms, such as a cyclopropyl group, a cyclopentyl group, and a cyclohexyl group. Examples of the aromatic group represented by $R^{21}$, $R^{22}$, $R^{23}$ and $R^{24}$ include those which contain from 6 to 20 carbon atoms, such as a phenyl group and a naphthyl group. $R^{21}$, $R^{22}$, $R^{23}$, and $R^{24}$ may be substituted by one or more substituents. Examples of suitable substituents include those described above as substituents for

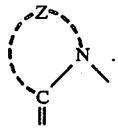

These substituents may be further substituted by substituents such as the substituents described as substituents for

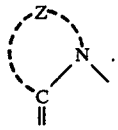

Particularly preferable examples of the group represented by $R^{21}$ and $R^{24}$ are substituted or unsubstituted aminoalkyl groups, and those of the group represented by $R^{22}$ and $R^{23}$ are a hydrogen atom or alkyl groups.

In the present invention, the compound of formula (I) may form a salt with an organic or inorganic acid. Examples of the organic acid include methanesulfonic acid, benzenesulfonic acid, p-toluenesulfonic acid, trifluoroacetic acid, trifluoromethanesulfonic acid, oxalic acid, and benzenephosphonic acid. Examples of the inorganic acid include hydrobromic acid, hydrochloric acid, hydroiodic acid, sulfuric acid, perchloric acid, tetrafluoroboric acid and phosphoric acid.

Specific examples of such compounds that can be used in the present invention are described below, which, however, does not limit the present invention in any way.

I-1

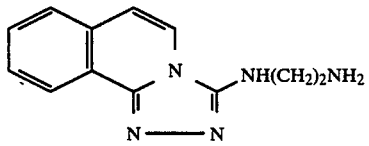

I-2

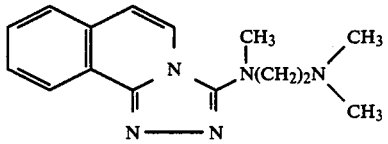

I-3

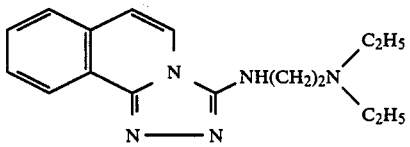

-continued
I-4
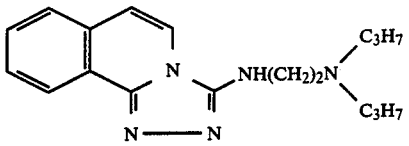
I-5
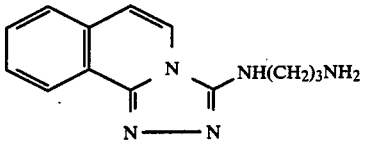
I-6
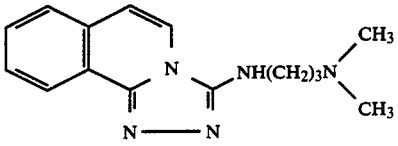
I-7
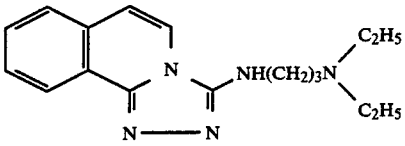
I-8
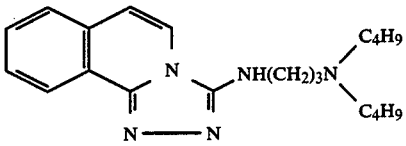
I-9
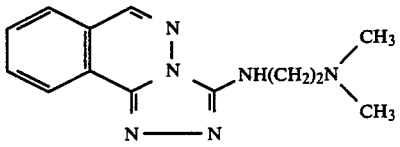
I-10
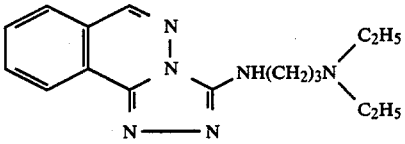
I-11
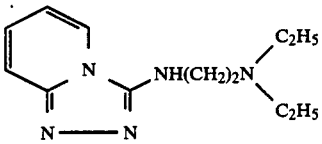
I-12
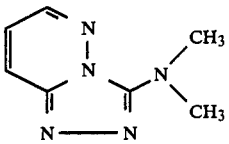
-continued
I-13
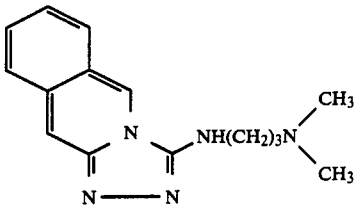
I-14
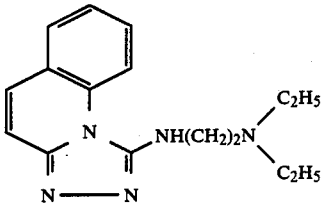
I-15
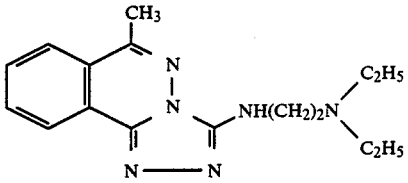
I-16
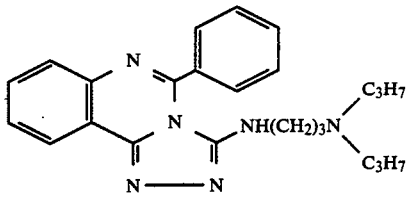
I-17
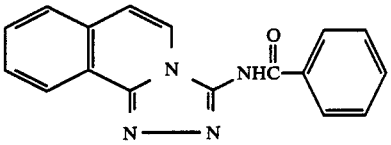
I-18
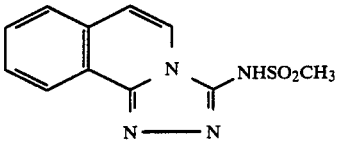
I-19
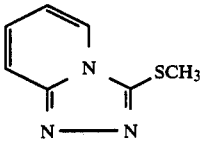
I-20
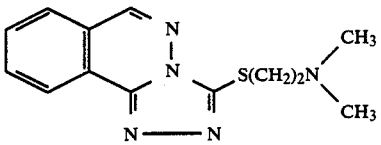
I-21
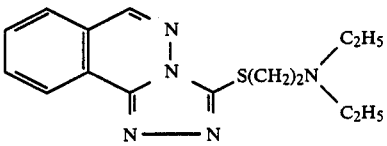

-continued

I-22

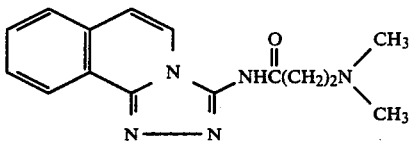

I-23

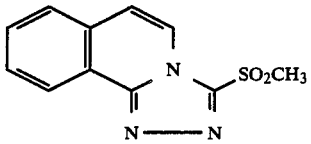

I-24

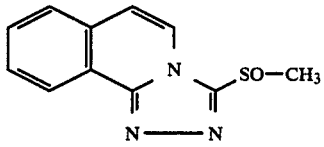

Some of the compounds illustrated above as specific examples of the compounds represented by formula (I) are commercially available. Such compounds may be readily synthesized by reference to, e.g., A. R. Katritzky & C. W. Rees, *Comprehensive Heterocyclic Chemistry-The Structure, Reactions, Synthesis, and Use of Heterocyclic Compounds,* Vol. 5 published by Pergamon Press, Oxford (1984), pp. 847–904.

In the course of studying various amino compounds to overcome the above-described defects that occur with the conventionally known development accelerators, the inventors have newly found amino compounds which cause considerably less fog in comparison with the conventional amino compounds, and which can markedly enhance sensitivity. In some cases, use of the compounds of the present invention can even increase gradation.

The compounds of the present invention may be incorporated in any one of silver halide emulsion layers or other hydrophilic colloidal layers in a photographic light-sensitive material. They may be added to a photographic emulsion layer or to other light-insensitive layer such as a protective layer, an interlayer, a filter layer, or an antihalation layer. Preferably, they are added to a silver halide photographic emulsion layer.

The compound in accordance with the present invention is usually added in an amount of from $1\times10^{-6}$ to $5\times10^{-2}$ mol, preferably from $5\times10^{-5}$ to $1\times10^{-2}$ mol, per mol of silver halide used in the photographic light-sensitive material.

The compounds of the pesent invention may be added to a photographic light-sensitive material in a manner commonly employed for adding additives to photographic emulsions. For example, water-soluble compounds are added as an aqueous solution of a proper concentration, whereas water-insoluble or slightly water-soluble compounds are added as a solution of a water-miscible organic solvent such as an alcohol, an ether, a glycol, a ketone, an ester, an amide, etc., that do not adversely affect photographic properties. Processes well known for adding water-insoluble (so-called oil-soluble) couplers to an emulsion in the form of a dispersion may also be employed.

In addition, the compounds of the present invention may be incorporated in processing solutions such as a developer or a pre-bath as described in U.S. Pat. No. 4,474,871. In this case, the compounds are preferably added in a concentration of $2\times10^{-5}$ to $1\times10^{-1}$ mol/liter, particularly preferably $1\times10^{-4}$ to $2\times10^{-2}$ mol/liter of processing solution.

Silver halide to be used in the present invention in a silver halide photographic material comprises silver chloride, silver chlorobromide, silver bromide, silver bromoiodide, or silver chlorobromoiodide. Mean grain size of silver halide grains is not particularly limited, but is preferably not more than 3 μm.

Grain size distribution may be narrow or broad.

Silver halide grains in the photographic emulsion may be in a regular crystal form such as cubic or octahedral form, in an irregular crystal form such as spherical or plate form, or in a mixed form thereof, or may comprise a mixture of grains in different forms.

The silver halide grains may have an inner portion and a surface layer different from or the same as each other in phase composition. In addition, silver halide grains of the type forming a latent image mainly on the surface thereof and grains of the type forming a latent image mainly within them may be used.

The photographic emulsion to be used in the present invention can be prepared by the processes described in P. Glafkides, *Chimie et Physique Photographique* (published by Paul Montel in 1967); G. F. Duffin, *Photographic Emulsion Chemistry* (published by The Focal Press Co. in 1966); V. L. Zelikman et al, *Making the Coating Photographic Emulsion* (published by The Focal Press Co. in 1964), and the like.

During formation or physical ripening of silver halide grains, cadmium salts, zinc salts, lead salts, thallium salts, iridium salts or the complex salts thereof, rhodium salts or the complex salts thereof, iron salts or the complex salts thereof, etc., may be allowed to coexist.

Silver halide emulsions may be used as so-called primitive emulsions without conducting chemical sensitization, but are usually chemically sensitized. Chemical sensitization can be conducted according to the processes described, for example, in *Die Grundlagen der Photographischen Prozesse mit Silber-halogeniden* (edited by H. Frieser and published by Akademische Verlagsgesellschaft in 1968), pp. 675–734. That is, a sulfur sensitization process using a thiosulfate, a thiourea, a thiazole, a rhodanine, etc. or active gelatin; reduction sensitization using a stannous salt, an amine, a hydrazine, a formamidinesulfinic acid, a silane compound, etc.; a noble metal sensitization process using complexes of the group VII metals such as platinum, iridium, palladium, etc., as well as gold complex salts; and the like can be employed alone or in combination.

The photographic emulsion of the present invention may contain a polyalkylene oxide or its ether, ester or amine derivative, a thioether compound, a thiomorpholine compound, a quaternary ammonium salt compound, an urethane derivative, a urea derivative, an imidazole derivative, a 3-pyrazolidone, etc., for the purpose of enhancing sensitivity or contrast or for accelerating development. For example, those described in U.S. Pat. Nos. 2,400,532, 2,423,549, 2,716,062, 3,617,280, 3,772,021, 3,808,003, etc. may be used.

To the photographic emulsion to be used in the present invention may be incorporated various compounds for the purpose of preventing formation of fog or stabilizing photographic properties in the steps of producing, or during storage or processing of, light-sensitive materials. That is, many compounds known as an antifoggants or stabilizers such as azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole), etc.); mercaptopyrimidines; mercaptotriazines; thioketo compounds (e.g., oxazolinethione, etc.); triazaindenes, 4-hydroxy-6-methyl(1,3,3a,7)tetrazaindene, pentazaindene, etc.; benzenesulfinic acid, benzenesulfonic acid amide, etc., known as antifoggants or stabilizers can be added.

As a binder or protective colloid to be used in the light-sensitive material, gelatin is advantageously used. However, other hydrophilic synthetic polymers or the like may be used as well. As gelatin, lime-processed gelatin, acid-processed gelatin, gelatin derivatives, etc., may also be used. More specifically, such binders are described in *Research Disclosure, Vol.* 176, RD No. 17643 (December 1978), item IX.

The light-sensitive material of the present invention may contain in its photographic emulsion layers or other hydrophilic colloidal layers various known surfactants for various purposes such as improvement of coating properties, antistatic properties, slipping properties, emulsion dispersibility, antiadhesion properties, and photographic properties (for example, development acceleration, realization of contrasting tone, sensitization, etc.).

For example, nonionic surfactants such as saponin, alkylene oxide derivatives (e.g., polyethylene glycols, polyalkylene glycol alkylamines or amides, silicone/-polyethylene oxide adducts, etc.), glycidol derivatives (e.g., alkenylsuccinic acid polyglycerides, etc.), fatty acid esters of polyhydric alcohols, alkyl esters of sucrose, urethanes or ethers; anionic surfactants such as triterpenoid-saponin, alkylcarboxylates, alkylbenzenesulfonates, alkylsulfates, alkyl phosphates, N-acyl-N-alkyltaurines, sulfosuccinates, sulfoalkyl polyoxyethylene alkylphenyl ethers, etc.; amphoteric surfactants such as amino acids, aminoalkylsulfonic acids, aminoalkylsulfates or phosphates, alkylbetaines, amineimides, amine oxides, etc.; and cationic surfactants such as alkylamine salts, aliphatic or aromatic quaternary ammonium salts, heterocyclic quaternary ammonium salts (e.g., pyridinium, imidazolium, etc.), phosphonium or sulfonium salts containing aliphatic or heterocyclic ring, etc. may be used.

Photographic emulsions of the present invention may be spectrally sensitized with methine dyes or the like. Dyes to be used include cyanine dyes, merocyanine dyes, complex cyanine dyes, complex merocyanine dyes, holopolar cyanine dyes, hemicyanine dyes, styryl dyes, and hemioxonol dyes. Particularly useful dyes are those belonging to merocyanine dyes, and complex merocyanine dyes. In these dyes, any of nuclei ordinarily used as basic heterocyclic ring nuclei in cyanine dyes can be used. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; those in which these nuclei are fused with an alicyclic hydrocarbon ring; and those in which these nuclei are fused with an aromatic ring, i.e., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., can be used. These nuclei may be substituted in the carbon atoms.

In the merocyanine dyes or complex merocyanine dyes, 5- or 6-membered heterocyclic ring nuclei such as a pyrazoline-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, etc., may be used as ketomethylene structure-containing nuclei.

The photographic light-sensitive material of the present invention contains in its photographic emulsion layers color-forming couplers capable of forming color by oxidative coupling with an aromatic primary amine developing agent (for example, a phenylenediamine derivative or an aminophenol derivative) in color development processing. Of these couplers, non-diffusible couplers having a hydrophobic group called ballast group or polymerized couplers are desirable. The couplers may be of either 4-equivalent type or 2-equivalent type based on silver ion. Colored couplers having color-correcting effect or couplers capable of releasing a development inhibitor upon development (called DIR couplers) may also be incorporated. In addition to DIR couplers, non-color-forming DIR coupling compounds capable of forming a colorless coupling reaction product and releasing a development inhibitor may also be incorporated.

For example, there are illustrated magenta couplers such as 5-pyrazolone couplers, pyrazolobenzimidazole couplers, cyanoacetylcoumarone couplers, open-chain acylacetonitrile couplers, etc.; yellow couplers such as acylacetamide couplers (e.g., benzoylacetanilides, pivaloylacetanilides, etc.), etc.; and cyan couplers such as naphthol couplers, phenol couplers, etc.

The light-sensitive material prepared according to the present invention may contain a hydroquinone derivative, an aminophenol derivative, a gallic acid derivative, an ascorbic acid derivative, etc., as antifogging agents.

In addition to the above-described compounds, the light-sensitive material to be used in the present invention may contain a desensitizing agent, a brightening agent, a hardener, a plasticizer, a slip-preventing agent, a matting agent, a high-boiling point organic solvent, a development accelerator, an antistatic agent, a stain-preventing agent, a dye, etc. As the aforesaid and these additives, those described in *Research Disclosure,* Vol. 176, RD No. 17643 (December 1978), items I to XVI (pp. 28–29) may be used.

The light-sensitive material to be prepared according to the present invention may contain in its hydrophilic layer a UV ray absorbent, such as a benzotriazole compound substituted by an aryl group.

The photographic emulsions of the present invention are coated on a flexible support such as plastic film (e.g., cellulose nitrate film, cellulose acetate film, polyethylene terephthalate film, etc.), or on a rigid support such as glass.

The photographic light-sensitive materials used in accordance with the present invention can be various color or black-and-white silver halide photographic light-sensitive materials. Examples include color positive-working materials, color papers, color negative-working materials, color reversal materials (containing or not containing couplers), plate-making photographic light-sensitive materials (for example, lith film), light-sensitive materials for cathode ray tube display, light-sensitive materials for recording X-rays (particularly materials for photographing directly or indirectly using a screen) and, in addition, materials adapted for colloid transfer process, silver salt diffusion transfer process, dye transfer process, or silver-dye bleach process, print-out light-sensitive materials, thermally developable light-sensitive materials, etc.

The present invention may also be applied to a multi-layered, multi-color photographic material comprising a support having provided thereon at least two layers different from each other in spectral sensitivity. Multi-layered, multi-color photographic materials usually comprise a support having provided thereon at least one red-sensitive emulsion layer, at least one green-sensitive emulsion layer, and at least one blue-sensitive emulsion layer. The order of these layers may be optionally selected as the case demands. The red-sensitive emulsion layer usually contains a cyan-forming coupler, the green-sensitive emulsion layer a magenta-forming coupler, and the blue-sensitive emulsion layer a yellow-forming coupler. However, in some cases, different combinations may be employed.

In the present invention, exposure for obtaining photographic image may be conducted in a conventional manner. That is, any of known various light sources may be employed such as natural light (sun-light), tungsten lamp, fluorescent lamp, mercury lamp, xenon arc lamp, carbon arc lamp, xenon flash lamp, flying spots on cathode ray tube, etc. As exposure time, not only an exposure time of 1/1000 sec to one second employed for ordinary cameras but an exposure time shorter than 1/1000, for example, $1/10^4$ to $1/10^6$ second using a xenon flash lamp or a cathode ray tube and an exposure time longer than one second may be used as well.

In photographic processing of the light-sensitive material of the present invention, any of known processes and any of known processing solutions may be used. Processing temperature is usually selected between 18° and 50° C. However, temperatures lower than 18° C. or higher than 50° C. may be employed. Either of development processing for forming silver image (black-and-white processing) and color photographic processing involving dye image-forming processing may be applied to the light-sensitive material of the present invention, depending upon the intended end-use.

Development processing may be conducted by reference to *Research Disclosure,* Vol. 176, RD No. 17643, pp. 28–29, ibid., Vol. 187, RD No. 18716, p. 651.

The developer for conducting black-and-white photographic processing can contain known developing agents. As the developing agents, dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, heterocyclic compounds wherein a 1,2,3,4-tetrahydroquinoline ring is fused with an indolenine ring described in U.S. Pat. No. 4,067,872 may be used alone or in combination. Generally, the developer further contains known preservatives, alkali agents, pH buffers, antifogging agents, etc., and, if desired, may further contain dissolving aids, toning agents, development accelerators, surfactants, defoaming agents, water-softening agents, hardeners, viscosity-imparting agents, etc.

As a fixing solution, those which have the same formulation as are ordinarily employed can be used. As the fixing agent, organic sulfur compounds which are known to function as fixing agents can be used, as well as thiosulfates and thiocyanates. The fixing solution may also contain a water-soluble aluminum salt as a hardener.

A color developer to be used in the present invention generally comprises an alkaline aqueous solution containing a color-developing agent. As the color-developing agent, known primary amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline, etc.) may be used.

In addition, those described in L. F. A. Mason, *Photographic Processing Chemistry* (published by Focal Press in 1966), pp. 226–229, U.S. Pat. Nos. 2,193,015 and 2,592,364, Japanese Patent Application (OPI) No. 64933/73 (the term "OPI" as used herein means an "unexamined published application"), etc.

The color developer may further contain pH buffers such as alkali metal sulfites, carbonates, borates, and phosphates, development inhibitors or antifoggants such as bromides, iodides, and organic antifoggants, and, if desired, may contain water softeners, preservatives such as hydroxylamine, organic solvents such as benzyl alcohol and diethylene glycol, development accelerators such as polyethylene glycol, quaternary ammonium salts, and amines, dye-forming couplers, competitive couplers, fogging agents such as sodium borohydride, auxiliary developing agents such as 1-phenyl-3-pyrazolidone, viscosity-imparting agent, polycarboxylic acid type chelating agents described in U.S. Pat. No. 4,083,723, antioxidants described in West German Patent Application (OLS) No. 2,622,950, and the like.

The color-developed photographic emulsion layers are usually bleached. Bleaching may be conducted independently or simultaneously with fixing.

The present invention is now illustrated in greater detail by reference to the following examples which, however, are not to be construed as limiting the present invention in any way.

EXAMPLE 1

To a silver bromoiodide emulsion containing 6 mol% of silver iodide (grain size: about 0.75μ) were added 5 mg of sodium thiosulfate, 3.5 mg of potassium chloroaurate, and 0.18 g of ammonium rhodanide per mol of silver halide, followed by ripening at 60° C. for 50 minutes.

This emulsion was divided into ten parts. To each part were added the compound of the present invention or a comparative compound as shown in Table 1, a hardener (sodium salt of 2,4-dichloro-6-hydroxy-1,3,5-triazine), and a coating aid (sodium dodecylbenzenesulfonate), and the resulting mixture was coated on a cellulose triacetate film and dried to obtain a sample.

Each of the samples was exposed for 1/100 second through an optical wedge, developed for 4 minutes at 20° C. using a developer, Kodak D-72, then subjected to conventional fixing, washing with water, and drying steps.

| Developer D-72 | |
|---|---|
| Metol | 3.1 g |
| Sodium sulfite | 45.0 g |
| Hydroquinone | 12.0 g |
| Sodium carbonate (monohydrate) | 79.0 g |

-continued

| Developer D-72 | |
|---|---|
| Potassium bromide | 1.9 g |
| Water to make | 1 liter |

In Table 1, relative sensitivity is presented as a relative value of a reciprocal of an exposure amount giving an optical density of fog+0.2, taking the value of sample No. 1 as 100.

TABLE 1

| Sample No. | Compound | Added Amount (mol/mol AgX) | Relative Sensitivity | Fog |
|---|---|---|---|---|
| 1 | — | — | 100 | 0.04 |
| 2 | I-6 | $1.8 \times 10^{-3}$ | 126 | 0.05 |
| 3 | I-6 | $5.4 \times 10^{-3}$ | 174 | 0.06 |
| 4 | I-8 | $0.01 \times 10^{-3}$ | 115 | 0.04 |
| 5 | I-8 | $0.02 \times 10^{-3}$ | 132 | 0.06 |
| 6 | I-21 | $1.4 \times 10^{-3}$ | 148 | 0.06 |
| 7 | Comparative Compound (A)* | $1.8 \times 10^{-3}$ | 138 | 0.15 |
| 8 | Comparative Compound (B)* | $1.8 \times 10^{-3}$ | 81 | 0.04 |
| 9 | Comparative Compound (C)* | $1.8 \times 10^{-3}$ | 85 | 0.06 |
| 10 | Comparative Compound (A)* Comparative Compound (B)* | $1.8 \times 10^{-3}$ $5.4 \times 10^{-3}$ | 83 | 0.04 |

*Comparative compounds (A)

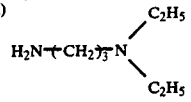

(B)

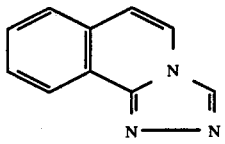

(C)

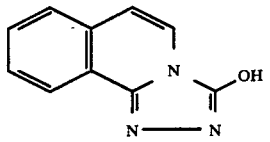

Compounds (B) and (C) are described in British Patent 868,787.

As is apparent from Table 1, the presence of the compound of the present invention serves to increase light sensitivity. Comparison with comparative compound (A) shows that the compounds of the present invention undergo a less increase of fog for the increase in light sensitivity. Comparative compounds (B) and (C) show no sensitizing effect.

EXAMPLE 2

A silver bromoiodide emulsion containing 2.0 mol% of silver iodide (mean grain size of silver halide: 1.0 μm) was ripened by adding thereto 0.6 mg of chloroauric acid and 3.4 mg of sodium thiosulfate per mol of silver halide, and heating at 60° C. for 50 minutes. To the resulting emulsion were added 4-hydroxy-6-methyl-1,3,3a,7-tetrazaindene as a stabilizer and 5-nitrobenzotriazole as an antifoggant, and, further, the compounds of the present invention shown in Table 2, and the resulting emulsion was coated on a film to prepare sample Nos. 11 to 21.

Each of these samples was exposed using a sensitometer, and developed for 90 seconds in an automatic developing machine, Fuji-RN, using a developer RD-III (made by Fuji Photo Film Co., Ltd.), followed by measuring photographic properties to obtain the results shown in Table 2.

Additionally, sensitivity in Table 2 is presented as a relative value of a reciprocal of an exposure amount necessary for giving a density of fog+0.2, taking that of sample No. 11 as 100. Comparative compounds (A) and (B) are the same as used in Example 1.

TABLE 2

| Sample No. | Compound | Added Amount (mol/mol AgX) | Relative Sensitivity | Fog |
|---|---|---|---|---|
| 11 | — | — | 100 | 0.07 |
| 12 | I-3 | $1.8 \times 10^{-3}$ | 126 | 0.07 |
| 13 | " | $3.6 \times 10^{-3}$ | 170 | 0.08 |
| 14 | " | $5.4 \times 10^{-3}$ | 250 | 0.10 |
| 15 | I-10 | $1.8 \times 10^{-3}$ | 115 | 0.07 |
| 16 | " | $3.6 \times 10^{-3}$ | 135 | 0.08 |
| 17 | " | $5.4 \times 10^{-3}$ | 151 | 0.08 |
| 18 | Comparative Compound (A) | $1.8 \times 10^{-3}$ | 130 | 0.12 |
| 19 | Comparative Compound (A) | $5.4 \times 10^{-3}$ | 180 | 0.22 |
| 20 | Comparative Compound (B) | $1.8 \times 10^{-3}$ | 89 | 0.07 |
| 21 | Comparative Compound (B) | $5.4 \times 10^{-3}$ | 70 | 0.06 |

As is clear from the results set forth in Table 2, use of comparative compound (A) resulted in increased fog together with increased sensitivity, whereas the compounds of the present invention caused less fog, even when used in higher molar concentrations.

Comparative compound (B) showed no sensitizing effect as described in British Pat. No. 868,787.

While the invention has been described in detail and with reference to specific embodiments thereof, it will be apparent to one skilled in the art that various changes and modifications can be made therein without departing from the spirit and scope thereof.

What is claimed is:

1. A process for processing a silver halide photographic material image-wise exposed to light, which comprises developing a silver halide photographic material in the presence of a compound represented by formula (I) or a salt thereof with an organic or inorganic acid:

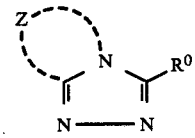

(I)

wherein

Z represents an atomic group of carbon atoms, nitrogen atoms or a combination thereof, forming a 5-, 6-, or 7-membered unsaturated heterocyclic, or condensed heterocyclic ring, wherein said unsaturated condensed heterocyclic ring is condensed with a monocyclic or dicyclic aryl group;

$R^0$ represents

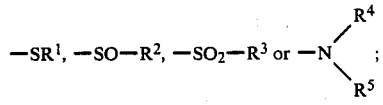

$-SR^1$, $-SO-R^2$, $-SO_2-R^3$ or $-N\begin{matrix}R^4\\R^5\end{matrix}$ ;

$R^1$ represents an alkyl group, a substituted alkyl group, an aryl group, or a substituted aryl group;

$R^2$ and $R^3$ each represents a hydrogen atom, an alkyl group, a substituted alkyl group, an aryl group, a substituted aryl group, an alkoxy group, a substituted alkoxy group, an amino group, or a substituted amino group;

$R^4$ represents a hydrogen atoms, an alkyl group, a substituted alkyl group, an aryl group or a substituted aryl group; and $R^5$ represents an acyl group, a sulfinyl group, a sulfonyl group, or a carbamoyl group, or represents a group selected from the groups represented by $R^1$, $R^2$, $R^3$ and $R^4$.

2. A process for processing a silver halide photographic material as in claim 1, wherein Z represents a 6-membered unsaturated heterocyclic ring.

3. A process for processing a silver halide photographic material as in claim 2, wherein said 6-membered ring is derived from a pyridine or pyridazine.

4. A process for processing a silver halide photographic material as in claim 3, wherein a benzene ring is fused to the pyridine or pyridazine ring.

5. A process for processing a silver halide photographic material as in claim 1, wherein said compound represented by formula (I) is present in an amount of from $1\times10^{-6}$ to $5\times10^{-2}$ mol per mol of silver halide in the photographic material.

6. A process for processing a silver halide photographic material as in claim 5, wherein said compound represented by formula (I) is present in an amount of from $5\times10^{-5}$ to $1\times10^{-2}$ mol per mol of silver halide in the photographic material.

7. A process for processing a silver halide photographic material as in claim 1, wherein said photographic material comprises a silver halide photographic emulsion layer and said compound represented by formula (I) is incorporated therein.

8. A process for processing a silver halide photographic material as in claim 7, wherein said compound represented by formula (I) is present in said silver halide photographic emulsion layer in an amount of from $5\times10^{-5}$ to $1\times10^{-2}$ mol per mol of silver halide in said emulsion layer.

9. A process for processing a silver halide photographic material as in claim 8, wherein said developing solution contains from $1\times10^{-4}$ to $2\times10^{-2}$ mol/liter of said compound represented by formula (I).

10. A process for processing a silver halide photographic material image-wise exposed to light, which comprises developing a silver halide photographic material in the presence of a compound represented by formula (I) or a salt thereof with an organic or inorganic acid:

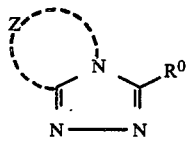

(I)

wherein

Z represents an atomic group of carbon atoms, nitrogen atoms or a combination thereof, forming a 5-, 6-, or 7-membered unsaturated heterocyclic, or condensed heterocyclic ring, wherein said unsaturated condensed heterocyclic ring is condensed with a monocyclic or dicyclic aryl group;

$R^0$ represents

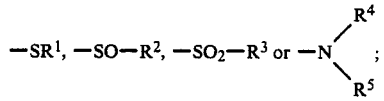

$R^1$ represents an alkyl group, a substituted alkyl group, an aryl group, or a substituted aryl group;

$R^2$ and $R^3$ each represents a hydrogen atom, an alkyl group, a substituted alkyl group, an aryl group, a substituted aryl group, an alkoxy group, a substituted alkoxy group, an amino group, or a substituted amino group;

$R^4$ represents a hydrogen atom, an alkyl group, a substituted alkyl group, an aryl group or a substituted aryl group; and $R^5$ represents an acyl group, a sulfinyl group, a sulfonyl group, or a carbamoyl group, or represents a group selected from the groups represented by $R^1$, $R^2$, $R^3$ and $R^4$, wherein said photographic material is developed with a developing solution containing from $2\times10^{-5}$ to $1\times10^{-1}$ mol/liter of said compound represented by formula (I).

11. A process for processing a silver halide photographic material as in claim 1, wherein the compound represented by formula (I) does not contain any hydroxyl group substituents in its structure.

* * * * *